US005111730A

United States Patent [19]

Grabner

[11] Patent Number: 5,111,730

[45] Date of Patent: May 12, 1992

[54] APPORTIONING APPARATUS FOR LOADING A LOADING TRAY WITH A VARIABLE NUMBER OF PROPELLING CHARGE MODULES

[75] Inventor: Dieter Grabner, Willich, Fed. Rep. of Germany

[73] Assignee: Rheinmetall GmbH, Dusseldorf, Fed. Rep. of Germany

[21] Appl. No.: 583,996

[22] Filed: Sep. 18, 1990

[30] Foreign Application Priority Data

Sep. 18, 1989 [DE] Fed. Rep. of Germany ..... 3931059

[51] Int. Cl.[5] ..... F41A 9/38

[52] U.S. Cl. ..... 89/45

[58] Field of Search ..... 89/34, 36.13, 45, 46, 89/47

[56] References Cited

U.S. PATENT DOCUMENTS 809,455 1/1906 Meigs et al. ..... 89/46

4,706,544 11/1987 Zielinski et al. ..... 89/46

FOREIGN PATENT DOCUMENTS 0301159 2/1989 European Pat. Off. .

1428711 11/1971 Fed. Rep. of Germany .

*Primary Examiner*—Stephen C. Bentley

*Attorney, Agent, or Firm*—Spencer, Frank & Schneider

[57] ABSTRACT

An apportioning apparatus in combination with a transporting device for transporting propelling charge modules in an axial direction of the transporting device and a loading tray for receiving propelling charge modules which are to be loaded into a gun. The apportioning apparatus is arranged opposite to the transporting device in the axial transporting direction of the propelling charge modules and extends laterally of and parallel to the loading tray. The apportioning apparatus includes at least one pusher which simultaneously transports a predetermined number of propelling charge modules transversely into the loading tray.

6 Claims, 2 Drawing Sheets

APPORTIONING APPARATUS FOR LOADING A LOADING TRAY WITH A VARIABLE NUMBER OF PROPELLING CHARGE MODULES

BACKGROUND OF THE INVENTION

The present invention relates to a propelling charge apportioning apparatus for use with a device for transporting propelling charge modules and a loading tray for loading the modules into a gun.

An apportioning apparatus is disclosed in German Patent No. 1,428,711, in which propelling charge modules are successively pushed by a hydraulically actuatable displacement device from a storage position into a loading tray and then, in order to load a gun, from the loading tray into a position behind the gun barrel from which they can be pushed into the chamber. For a long set of propelling charge modules, there exists the drawback that a comparatively long time is required to load the loading tray with the propelling charge modules which are successively introduced into the loading tray in their longitudinal direction. The prior art arrangement for loading the loading tray is thus counterproductive to increasing the firing cadence.

German Patent No. 3,437,588.A1 (corresponding to U.S. Pat. No. 4,706,544) discloses a loading tray which is fixed to a transfer arm that is pivotal about a trunnion in a gun. The loading tray itself is able to receive propelling charge modules in various numbers coming directly from a propelling charge magazine, on the one hand, in the same axial direction and, on the other hand, in the transverse direction. The supply of propelling charge modules is here determined by the configuration of the propelling charge magazine, wherein the propelling charge magazine is in the form of a chute magazine with transverse partitions requiring a lever mechanism that is integrated in the magazine for directly transporting the propelling charge modules that are arranged in magazine chutes disposed transversely to the loading tray into the loading tray. However, for the supply of propelling charge modules from the magazine chutes disposed along the sides of the loading tray into the loading tray, the propelling charge modules must likewise by pushed into the loading tray one after the other.

SUMMARY OF THE INVENTION

It is an object of the invention to make available a propelling charge module apportioning apparatus which permits the simultaneous supply of a variable number of propelling charge modules into a loading tray independently of the magazine.

The above and other objects are accomplished in accordance with the invention by the provision of an apportioning apparatus in combination with a transporting device for transporting propelling charge modules in an axial direction of the transporting device and a loading tray for receiving propelling charge modules which are to be loaded into a gun, wherein the apportioning apparatus is arranged opposite to the transporting device in an axial transporting direction of the propelling charge modules and extends laterally of and parallel to the loading tray; and the apportioning apparatus includes at least one pusher which simultaneously transports a predetermined number of propelling charge modules transversely into the loading tray.

The apportioning apparatus according to the invention constitutes an independent transfer station for the propelling charge modules and is not connected with a propelling charge magazine. Advantageously, it is able to selectively pick up propelling charge modules from various different types of magazines, for example from drum, belt, chain, bulk material or chute magazines, and simultaneously is able to transfer a set of propelling charge modules composed of one to n propelling charge modules into a loading tray.

In a further advantageous manner, each propelling charge module disposed in the apportioning apparatus may be driven individually by a transverse pusher and thus a set having a variable number of propelling charge modules can be pushed transversely into the loading tray on the shortest path for further transport behind the gun barrel. Thus it is possible to realize, independently of the specific feed rate of the magazine for the propelling charge modules, an unchanging, short loading time for the loading tray.

The invention will now be described in greater detail with reference to two embodiments that are illustrated in the drawing figures.

DETAILED DESCRIPTION OF THE PREFERRED EMBODIMENTS

Figure 1:
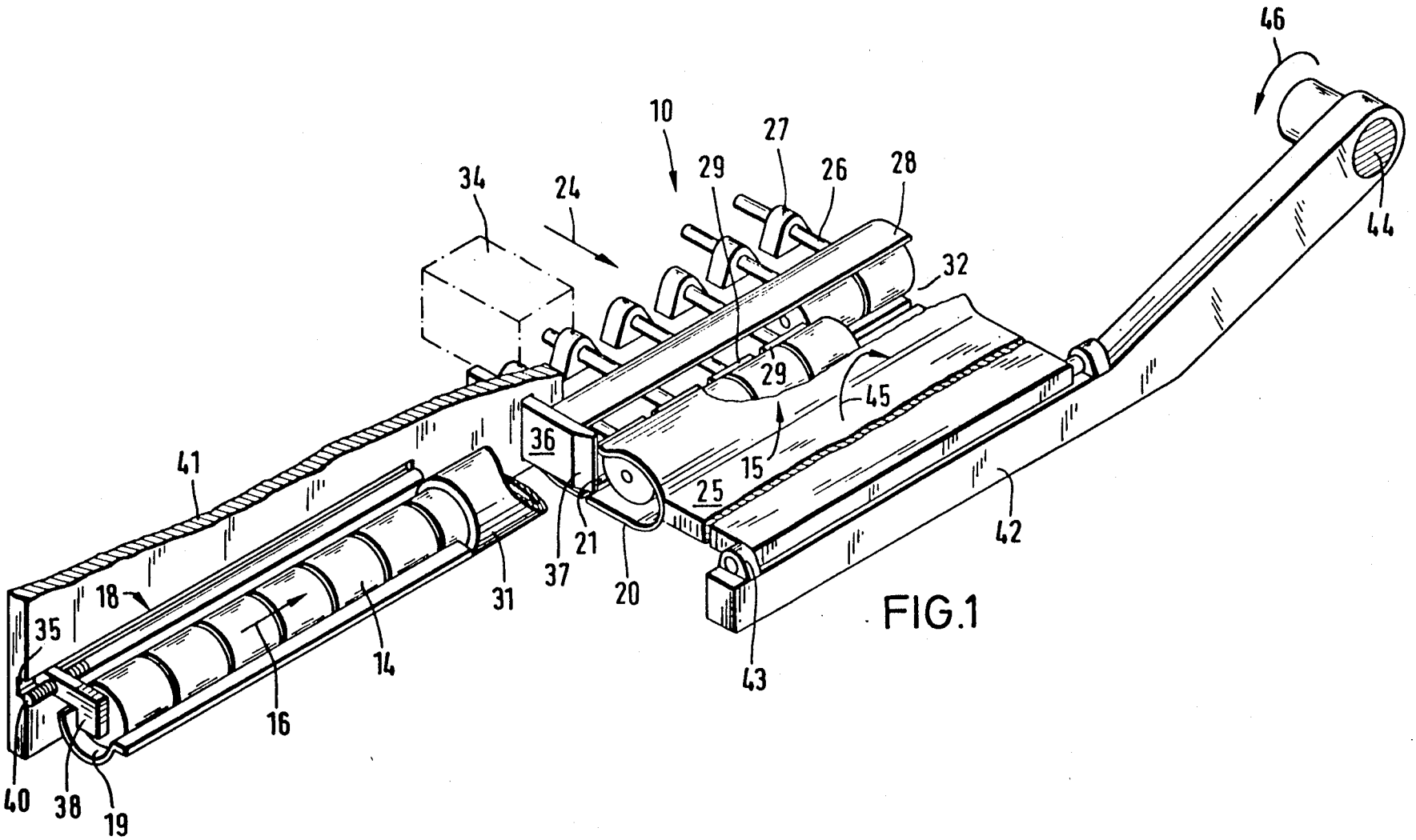
FIG. 1 is a perspective view of an apportioning apparatus according to one embodiment of the invention in which the propelling charge modules received from a transporting device are individually displaced transversely into a loading tray.
Figure 2:
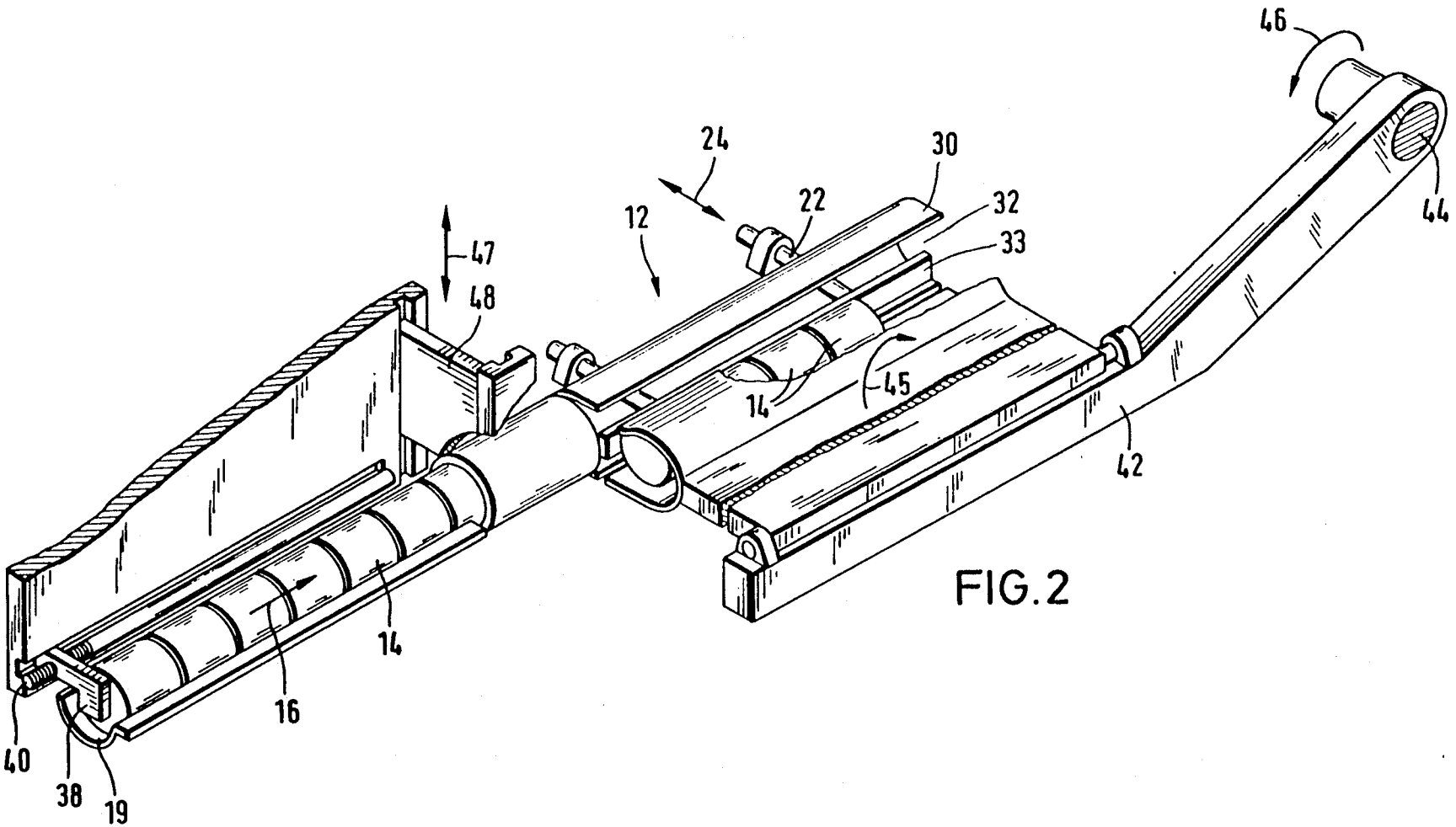
FIG. 2 is a perspective view of an apportioning apparatus according to another embodiment of the invention in which pre-apportioned propelling charge modules received from a transporting device are jointly displaced in a transverse direction into a loading.

Referring to FIGS. 1 and 2, there are shown two embodiments, respectively, of an apportioning apparatus which in each case is arranged opposite a transporting device 18, which is preferably in operative connection with a propelling charge magazine (not shown), in the displacement direction 16 of the propelling charge modules 14 and opposite to (i.e., laterally of and parallel to) a loading tray 20 which is pivotal about a transfer arm 42. Transfer arm 42 is mounted to pivot about a trunnion axis 44 of a gun barrel (not shown), while apportioning apparatuses 10 and 12 and the propelling charge magazine may be fastened directly to an armored turret (not shown).

Apportioning apparatuses 10 and 12 each include a housing 28, 30, respectively, that has a U-shape in the longitudinal direction and is open on its side 32 facing loading tray 20.

Apportioning apparatus 10 shown in FIG. 1 includes, on the rear face of its housing 28, a plurality of pushers 26 that are movable in a transverse direction 24, with each pusher associated with a respective propelling charge module 14. In this way, it is possible to simultaneously supply loading tray 20 with a variable number of propelling charge modules 14 in a set 15 of such modules, thus shortening the loading cadence. In the embodiment shown in FIG. 1, four of the six illustrated pushers 26 have been moved transversely in a reliable, simultaneous and rapid manner by means of individual drives 34, for example hydraulic piston-cylinder units (indicated only in phantom lines), in order to load loading tray 20. The respective, individually driven pushers 26 are each additionally supported in a stable manner in a bearing 27 disposed outside of apportioning apparatus 10. The end of each pusher 26 projecting into housing 28 is provided with a pusher surface 29 which is adapted to the length and diameter of a propelling charge module 14 so as to provide for a gentle transverse displacement of propelling charge modules 14.

Propelling charge modules 14 are supplied to apportioning apparatus 10 from one end in an axial direction 16, for which purpose transporting device 18 includes a propelling charge collecting trough 19 which is in operative connection (in a manner not shown) with the propelling charge module magazine and a pusher 38 for displacing the propelling charge modules 14 transferred from the magazine into collecting trough 19. Pusher 38 is arranged transversely to collecting trough 19 and is form-lockingly connected by way of a nut-like extension with a threaded spindle 40. Threaded spindle 40 is connected, in a manner not shown, with a drive motor and a brake so that it is possible, in an advantageous manner, to realize, in addition to a space saving and robust structure, high positioning accuracy for the propelling charge modules when they are supplied into apportioning apparatuses 10, 12. Threaded spindle 40 is preferably mounted to be rotated next to a wall 41 of the magazine (not shown), while the extension of pusher 38 is guided in a longitudinal groove 35 in wall 41.

In order to protect propelling charge modules 14, which are displaceable by way of a connecting tube 31 from collecting trough 19 into apportioning apparatus 10, against the propelling charge magazine and the propelling charge modules 14 in collecting trough 19, a bulkhead door 36 is mounted in wall 41 transversely to the displacement direction 16 of propelling charge modules 14. Bulkhead door 36 is sloped in its frontal region so that it can be pushed gently between the propelling charge modules 14 and perform a quantity limitation of the propelling charge modules 14 to be received by apportioning apparatus 10.

Loading tray 20 likewise has a U-shape and its open, long side 21 directly faces the open, long side 32 of apportioning apparatus 10. The closed rear side of propelling charge tray 20 is connected by way of a web 25 with a bearing 43 disposed on transfer arm 42 and can thus be pivoted upward about transfer arm 42 in direction 45. In its pivoted-down position, transfer arm 42, which is rotatable about trunnion axis 44, picks up the propelling charge modules 14 by way of loading tray 20 from apportioning apparatus 10 in the shortest possible loading time and then pivots them in a direction opposite to direction 46, into a position behind the gun barrel for the immediate introduction into a gun barrel chamber (not shown).

In the embodiment shown in FIG. 2, two pushers 22 which, are driven in parallel in the manner described above, are provided at apportioning apparatus 12. They are connected with one another in the interior of apportioning apparatus 12 by way of a single pusher surface 33 which corresponds to the length of apportioning apparatus 12. The bulkhead door which, in this case, is movable in a vertical direction 47 predetermines the number of propelling charge modules 14 for apportioning apparatus 12 that are likewise supplied jointly in a short time to loading tray 20 by way of pusher surface 33.

Obviously, numerous and additional modifications and variations of the present invention are possible in light of the above teachings. It is therefore to be understood that within the scope of the appended claims, the invention may be practiced otherwise than as specifically claimed.

What is claimed is:

1. An apportioning apparatus in combination with a transporting device for transporting propelling charge modules in an axial direction of the transporting device and a loading tray for receiving propelling charge modules which are to be loaded into a gun, wherein said apportioning apparatus is arranged opposite to said transporting device in an axial transporting direction of the propelling charge modules and extends laterally of and parallel to the loading tray; and said apportioning apparatus comprises at least one pusher which simultaneously transports a predetermined number of propelling charge modules transversely into the loading tray.

2. A combination as defined in claim 1, wherein said at least one pusher comprises a number of pushers corresponding to the maximum number of propelling charge modules disposed in the propelling charge apportioning apparatus, with the pushers arranged so that each pusher is associated with a respective one of the propelling charge modules to be transported transversely into the loading tray.

3. A combination as defined in claim 1, wherein said apparatus comprises a housing which has a U-shape in the longitudinal direction of said apparatus, with the open side of the U-shaped housing facing the loading tray.

4. A combination as defined in claim 1, wherein said apparatus further comprises individual drive means associated with each said pusher for driving the respective pushers.

5. A combination as defined in claim 1, further comprising a bulkhead door mounted between said transporting device and said apparatus for displacement in a direction transversely to the axial displacement direction of the propelling charge modules.

6. A combination as defined in claim 1, wherein said transporting device includes a rotatable threaded spindle extending axially of said transporting device and a further pusher in form locking connection with said threaded spindle for pushing the propelling charge modules in the axial direction of said transporting device.

* * * * *